US005855403A

United States Patent [19]

Harper

[11] Patent Number: 5,855,403

[45] Date of Patent: Jan. 5, 1999

[54] BAG CARRYING DEVICE

[76] Inventor: George A. Harper, 12243 Capital Blvd. Ste 707, Wake Forest, N.C. 27587

[21] Appl. No.: 70,656

[22] Filed: Apr. 30, 1998

[51] Int. Cl.[6] ..... B65D 33/06

[52] U.S. Cl. ..... 294/158; 294/137; 294/166

[58] Field of Search ..... 294/137, 141–143, 294/158, 159, 163, 165–167, 170; 16/114 R, 114 B; 383/6, 13, 25, 26, 29; D9/434, 455

[56] References Cited

U.S. PATENT DOCUMENTS

| | | | |
|---|---|---|---|
| D. 356,261 | 3/1995 | Miceli | 294/137 X |
| D. 358,094 | 5/1995 | DeGiacomo | 294/137 X |
| 4,301,575 | 11/1981 | Goldberg | 294/158 X |
| 4,772,059 | 9/1988 | Parry et al. | 294/158 X |
| 5,150,938 | 9/1992 | Gans | 294/158 X |
| 5,263,755 | 11/1993 | Thompson | 294/137 X |
| 5,441,323 | 8/1995 | Goddard | 294/158 |

*Primary Examiner*—Johnny D. Cherry

[57] ABSTRACT

A new bag carrying device for carrying multiple bags, particularly plastic grocery bags. The inventive device includes an elongate top portion spaced apart from an elongate bottom portion. An elongate first side portion is extended between the top portion and the bottom portion. An elongate second side portion is extended from the top portion towards the bottom portion and is spaced apart from the first side portion. The second side portion has a root and a free end, the root of the second side portion is positioned adjacent an end of the top portion while the free end of the second side portion is extended towards the bottom portion. The adjacent end of the bottom portion has a tab extending therefrom towards the top portion. The free end of the second side portion is biased towards the tab. The root of the second side portion is resiliently deflectable such that the free end of the second side portion may be deflected away from tab.

10 Claims, 2 Drawing Sheets

BAG CARRYING DEVICE

BACKGROUND OF THE INVENTION

1. Field of the Invention

The present invention relates to devices for carrying bags having handles and more particularly pertains to a new bag carrying device for carrying multiple bags, particularly plastic grocery bags.

2. Description of the Prior Art

The use of devices for carrying bags having handles is known in the prior art. More specifically, devices for carrying bags having handles heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for carrying bags having handles include U.S. Pat. No. 5,020,750; U.S. Pat. No. 5,190,253; U.S. Pat. No. Des. 308,271; U.S. Pat. No. 4,930,734; U.S. Pat. No. 4,821,985; and U.S. Pat. No. 4,750,694.

While these devices fulfill their respective, particular objectives and requirements, the aforementioned patents do not disclose a new bag carrying device. The inventive device includes an elongate top portion spaced apart from an elongate bottom portion. An elongate first side portion is extended between the top portion and the bottom portion. An elongate second side portion is extended from the top portion towards the bottom portion and is spaced apart from the first side portion. The second side portion has a root and a free end, the root of the second side portion is positioned adjacent an end of the top portion while the free end of the second side portion is extended towards the bottom portion. The adjacent end of the bottom portion has a tab extending therefrom towards the top portion. The free end of the second side portion is biased towards the tab. The root of the second side portion is resiliently deflectable such that the free end of the second side portion may be deflected away from tab.

In these respects, the bag carrying device according to the present invention substantially departs from the conventional concepts and designs of the prior art, and in so doing provides an apparatus primarily developed for the purpose of carrying multiple bags, particularly plastic grocery bags.

SUMMARY OF THE INVENTION

In view of the foregoing disadvantages inherent in the known types of devices for carrying bags having handles now present in the prior art, the present invention provides a new bag carrying device construction wherein the same can be utilized for carrying multiple bags, particularly plastic grocery bags.

The general purpose of the present invention, which will be described subsequently in greater detail, is to provide a new bag carrying device apparatus and method which has many of the advantages of the devices for carrying bags having handles mentioned heretofore and many novel features that result in a new bag carrying device which is not anticipated, rendered obvious, suggested, or even implied by any of the prior art devices for carrying bags having handles, either alone or in any combination thereof.

To attain this, the present invention generally comprises an elongate top portion spaced apart from an elongate bottom portion. An elongate first side portion is extended between the top portion and the bottom portion. An elongate second side portion is extended from the top portion towards the bottom portion and is spaced apart from the first side portion. The second side portion has a root and a free end, the root of the second side portion is positioned adjacent an end of the top portion while the free end of the second side portion is extended towards the bottom portion. The adjacent end of the bottom portion has a tab extending therefrom towards the top portion. The free end of the second side portion is biased towards the tab. The root of the second side portion is resiliently deflectable such that the free end of the second side portion may be deflected away from tab.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bag carrying device apparatus and method which has many of the advantages of the devices for carrying bags having handles mentioned heretofore and many novel features that result in a new bag carrying device which is not anticipated, rendered obvious, suggested, or even implied by any of the prior art devices for carrying bags having handles, either alone or in any combination thereof.

It is another object of the present invention to provide a new bag carrying device which may be easily and efficiently manufactured and marketed.

It is a further object of the present invention to provide a new bag carrying device which is of a durable and reliable construction.

An even further object of the present invention is to provide a new bag carrying device which is susceptible of a low cost of manufacture with regard to both materials and labor, and which accordingly is then susceptible of low prices of sale to the consuming public, thereby making such bag carrying device economically available to the buying public.

Still yet another object of the present invention is to provide a new bag carrying device which provides in the apparatuses and methods of the prior art some of the advantages thereof, while simultaneously overcoming some of the disadvantages normally associated therewith.

Still another object of the present invention is to provide a new bag carrying device for carrying multiple bags, particularly plastic grocery bags.

Yet another object of the present invention is to provide a new bag carrying device which includes an elongate top portion spaced apart from an elongate bottom portion. An elongate first side portion is extended between the top portion and the bottom portion. An elongate second side portion is extended from the top portion towards the bottom portion and is spaced apart from the first side portion. The second side portion has a root and a free end, the root of the second side portion is positioned adjacent an end of the top portion while the free end of the second side portion is extended towards the bottom portion. The adjacent end of the bottom portion has a tab extending therefrom towards the top portion. The free end of the second side portion is biased towards the tab. The root of the second side portion is resiliently deflectable such that the free end of the second side portion may be deflected away from tab.

Still yet another object of the present invention is to provide a new bag carrying device that allows a user to easily carry several loaded plastic grocery bags in one hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
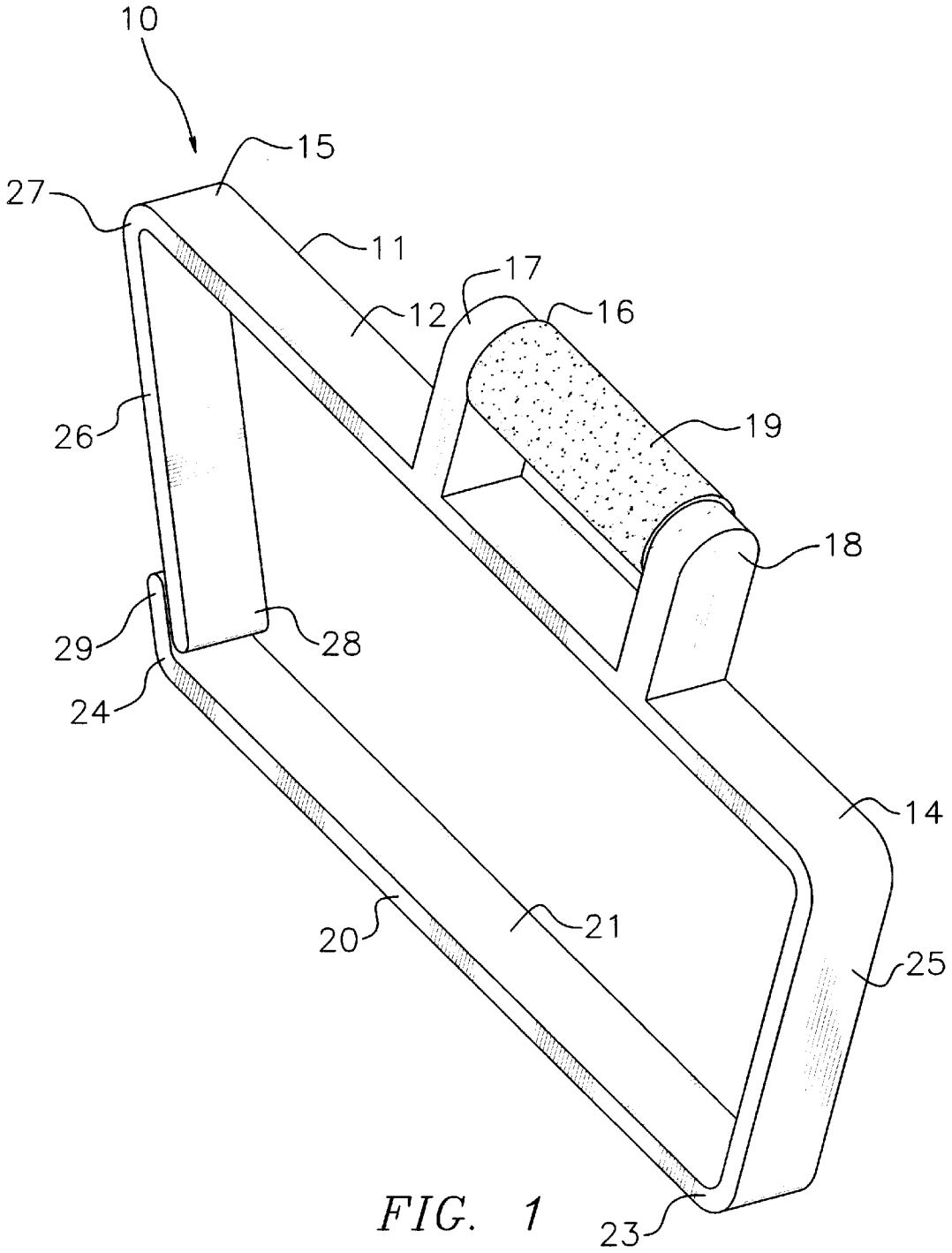
FIG. 1 is a schematic perspective view of a new bag carrying device according to the present invention.
Figure 2:
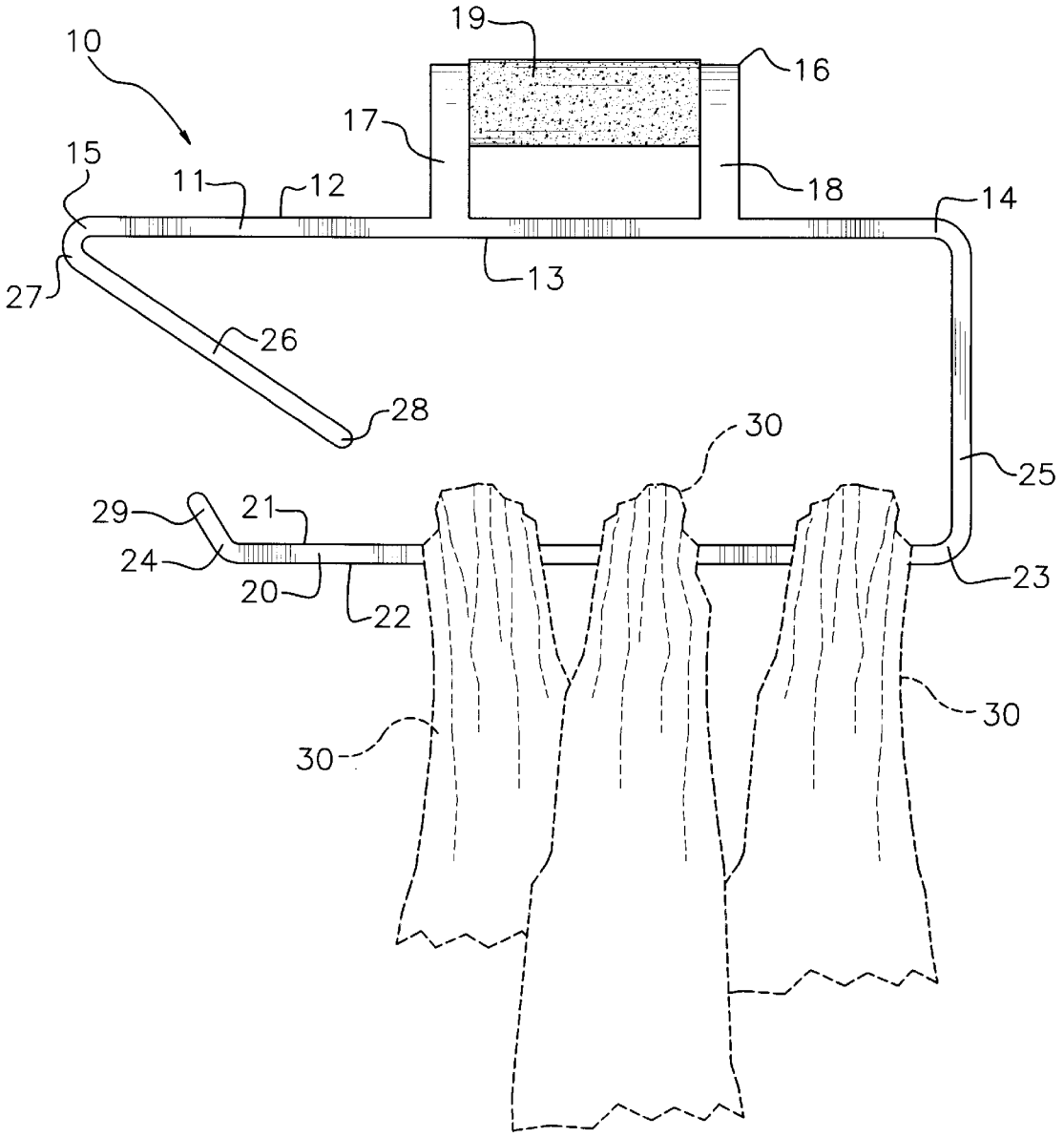
FIG. 2 is a schematic side view of the present invention illustrating the suspending of handles of bags on the bottom portion.

With reference now to the drawings, and in particular to FIGS. 1 through 2 thereof, a new bag carrying device embodying the principles and concepts of the present invention and generally designated by the reference numeral 10 will be described.

As best illustrated in FIGS. 1 through 2, the bag carrying device 10 generally comprises an elongate top portion 11 spaced apart from an elongate bottom portion 20. An elongate first side portion 25 is extended between the top portion 11 and the bottom portion 20. An elongate second side portion 26 is extended from the top portion 11 towards the bottom portion 20 and is spaced apart from the first side portion 25. The second side portion 26 has a root 27 and a free end 28, the root 27 of the second side portion 26 is positioned adjacent an end 15 of the top portion 11 while the free end 28 of the second side portion 26 is extended towards the bottom portion 20. The adjacent end 24 of the bottom portion 20 has a tab 29 extending therefrom towards the top portion 11. The free end 28 of the second side portion 26 is biased towards the tab 29. The root 27 of the second side portion 26 is resiliently deflectable such that the free end 28 of the second side portion 26 may be deflected away from tab 29.

In closer detail, the elongate top portion 11 has top and bottom surfaces 12,13, and opposite first and second ends 14,15. The top portion 11 has a length defined between the first and second ends 14,15 of the top portion 11. Preferably, the top portion 11 has a generally rectangular cross section taken substantially perpendicular to the length of the top portion 11. The bottom portion 20 has top and bottom surfaces 21,22, and opposite third and fourth ends 23,24. The length of the bottom portion is defined between the third and fourth ends 23,24. The length of the bottom portion 20 is less than the length of the top portion 11. Like the top portion, the bottom portion 20 preferably has a generally rectangular cross section taken substantially perpendicular to the length of the bottom portion 20. The top portion 11 is spaced apart from the bottom portion 20 with the bottom surface 13 of the top portion 11 facing the top surface 21 of the bottom portion 20. Preferably the length of the top portion 11 is substantially parallel to the length of the bottom portion 20.

The elongate first side portion 25 is extended between the bottom surface 13 of the top portion 11 and the top surface 21 of the bottom portion 20. Preferably, the first side portion 25 is positioned adjacent the first end 14 of the top portion 11 and the third end 23 of the bottom portion 20. The length of the first side portion 25 is defined between the top and bottom portions 11,20. Preferably, the length of the first side portion 25 extends substantially perpendicular to the length of the top portion 11 and the length of the bottom portion 20. Like the top and bottom portions, the first side portion 25 also preferably has a generally rectangular cross section taken substantially perpendicular to the length of the first side portion 25.

The elongate second side portion 26 extends from the bottom surface 13 of the top portion 11 towards the bottom portion 20. The second side portion 26 has a root 27 and a free end 28. The root 27 of the second side portion 26 is positioned adjacent the second end 15 of the top portion 11 while the free end 28 of the second side portion 26 extends towards the top surface 21 of the bottom portion 20. The second side portion 26 has a length defined between the root 27 and free end 28 of the second side portion 26. The length of the second side portion 26 is preferably extended at an acute angle with respect to the length of the top portion 11.

The fourth end 24 of the bottom portion 20 has a tab 29 extending from the top surface 21 of the bottom portion 20 towards the top portion 11. The tab 29 is preferably extended from the bottom portion 20 at an obtuse angle with respect to the length of the bottom portion 20. The free end 28 of the second side portion 26 is biased towards the tab 29 so that the free end abuts the tab. The root 27 of the second side portion 26 is resiliently deflectable such that the free end 28 of the second side portion 26 may be deflected away from tab 29 of the bottom portion 20 to open a gap between the tab and the second side portion.

Preferably, the top surface 12 of the top portion 11 has a handle 16 extending therefrom for permitting the carrying of the device by a user. Preferably, the handle 16 is a generally inverted U-shape and has a pair of spaced apart arms 17,18 and a cross portion 19 extending between the arms 17,18. The arms 17,18 are coupled to the top portion 11, the cross portion 19 is spaced apart from the top surface 12 of the top portion 11 while the length of the cross portion 19 is substantially parallel to the length of the top portion 11. In an ideal embodiment, the cross portion 19 is generally cylindrical and has a padded outer layer therearound. Ideally, the padded outer layer comprises a resiliently compressible material such as a foamed rubber.

In use, the fourth end 24 of the bottom portion 20 is designed for inserting through the handles of bags 30, preferably plastic grocery bags, such that the bags may be suspended on the bottom portion 20. The free end of the second side portion is deflected away from the tab such that a gap is formed therebetween to permit passage therethrough of a portion of the handle of a bag 30 on the bottom portion. A number of bags may thus be carried by a user by suspending the bags from their handles on the bottom portion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for carrying bags, comprising:

an elongate top portion having opposite first and second ends, and a length defined between said first and second ends of said top portion;

a bottom portion having opposite third and fourth ends, and a length defined between said third and fourth ends of said bottom portion;

said top portion being spaced apart from said bottom portion;

an elongate first side portion being extended between said top portion and said bottom portion;

said first side portion having a length;

an elongate second side portion being extended from said top portion towards said bottom portion;

said second side portion having a root and a free end, said root of said second side portion being positioned adjacent said second end of said top portion, said free end of said second side portion being extended towards said bottom portion;

said second side portion having a length defined between said root and free end of said second side portion;

said fourth end of said bottom portion having a tab extending therefrom towards said top portion;

said free end of said second side portion being biased towards said tab; and said root of said second side portion being resiliently deflectable such that said free end of said second side portion may be deflected away from tab.

2. The device of claim 1, wherein said top portion has a handle extending therefrom.

3. The device of claim 2, wherein said handle is a generally inverted U-shape and has a pair of spaced apart arms and a cross portion extending between said arms of said handle, said arms being coupled to said top portion, said cross portion being spaced apart from the top surface of said top portion, said cross portion having a length, said length of said cross portion being substantially parallel to said length of said top portion.

4. The device of claim 3, wherein said cross portion has a padded outer layer, wherein said padded outer layer comprises a resiliently compressible material.

5. The device of claim 1, wherein said length of said top portion is substantially parallel to said length of said bottom portion.

6. The device of claim 1, wherein said length of said bottom portion is less than said length of said top portion.

7. The device of claim 1, wherein said first side portion is positioned adjacent said first end of said top portion and said third end of said bottom portion.

8. The device of claim 1, wherein said length of said first side portion is extended substantially perpendicular to said length of said top portion and said length of said bottom portion.

9. The device of claim 1, wherein said length of said second side portion is extended at an acute angle with respect to said length of said top portion, and wherein said tab is extended from said bottom portion at an obtuse angle with respect to said length of said bottom portion.

10. A device for carrying bags, comprising:

an elongate top portion having top and bottom surfaces, opposite first and second ends, and a length defined between said first and second ends of said top portion;

said top portion having a generally rectangular cross section taken substantially perpendicular to said length of said top portion;

said top surface of said top portion having a handle extending therefrom, said handle being a generally inverted U-shape and having a pair of spaced apart arms and a cross portion extending between said arms of said handle, said arms being coupled to said top portion, said cross portion being spaced apart from said top surface of said top portion, said cross portion being generally cylindrical and having a length, said length of said cross portion being substantially parallel to said length of said top portion, wherein said cross portion has a padded outer layer, wherein said padded outer layer comprises a resiliently compressible material;

a bottom portion having top and bottom surfaces, opposite third and fourth ends, and a length defined between said third and fourth ends of said bottom portion;

said bottom portion having a generally rectangular cross section taken substantially perpendicular to said length of said bottom portion;

said top portion being spaced apart from said bottom portion, said length of said top portion being substantially parallel to said length of said bottom portion, said bottom surface of said top portion facing said top surface of said bottom portion;

said length of said bottom portion being less than said length of said top portion;

an elongate first side portion being extended between said bottom surface of said top portion and said top surface of said bottom portion, said first side portion being positioned adjacent said first end of said top portion and said third end of said bottom portion;

said first side portion having a length, said length of said first side portion being extended substantially perpendicular to said length of said top portion and said length of said bottom portion;

said first side portion having a generally rectangular cross section taken substantially perpendicular to said length of said first side portion;

an elongate second side portion being extended from said bottom surface of said top portion towards said bottom portion;

said second side portion having a root and a free end, said root of said second side portion being positioned adjacent said second end of said top portion, said free end of said second side portion being extended towards said top surface of said bottom portion;

said second side portion having a length defined between said root and free end of said second side portion, said length of said second side portion being extended at an acute angle with respect to said length of said top portion;

said fourth end of said bottom portion having a tab extending from said top surface of said bottom portion towards said top portion, said tab being extended from said bottom portion at an obtuse angle with respect to said length of said bottom portion;

said free end of said second side portion being biased towards said tab; and said root of said second side portion being resiliently deflectable such that said free end of said second side portion may be deflected away from tab.

* * * * *